US008067353B2

(12) United States Patent
Collier et al.

(10) Patent No.: US 8,067,353 B2
(45) Date of Patent: Nov. 29, 2011

(54) METHOD FOR MAKING A FABRIC SOFTENER UTILIZING A DYNAMIC ORIFICE CHANGER

(75) Inventors: Montgomery Clay Collier, Hamilton, OH (US); Francesc Corominas, Grimbergen (BE); Ilse Maria Cyrilla D'Haeseleer, Sint-Gillis (BE); Kurt Louis Antoine Ignoul, Diepenbeek (BE); Katrien Maria Nuyts, Denderleeuw (BE); Etienne Maria Betty Andre Jeuniaux, Merchtem (BE); Jerry Keith McGinnis, Cleveland, TN (US)

(73) Assignee: The Procter & Gamble Company, Cincinnati, OH (US)

( * ) Notice: Subject to any disclaimer, the term of this patent is extended or adjusted under 35 U.S.C. 154(b) by 33 days.

(21) Appl. No.: 12/779,098

(22) Filed: May 13, 2010

(65) Prior Publication Data

US 2011/0124548 A1 May 26, 2011

(30) Foreign Application Priority Data

Aug. 18, 2009 (CA) ..... 2675704

(51) Int. Cl.
*C11D 1/62* (2006.01)

(52) U.S. Cl. ..... 510/287; 510/276; 510/322; 510/327; 510/329; 510/330; 510/394; 510/504; 510/515

(58) Field of Classification Search ..... 510/276, 510/287, 322, 327, 329, 330, 394, 504, 515
See application file for complete search history.

(56) References Cited

U.S. PATENT DOCUMENTS

| | | | | |
|---|---|---|---|---|
| 2,663,467 | A | | 12/1953 | Douglass et al. |
| 4,621,023 | A | | 11/1986 | Redziniak et al. |
| 4,816,170 | A | * | 3/1989 | Jacques et al. ..... 510/527 |
| 4,895,452 | A | | 1/1990 | Yiournas et al. |
| 5,380,089 | A | | 1/1995 | Karasawa |
| 2007/0099817 | A1 | | 5/2007 | Smith et al. |
| 2008/0061459 | A1 | | 3/2008 | Nakajima et al. |

FOREIGN PATENT DOCUMENTS

| | | |
|---|---|---|
| GB | 1 019 035 A | 2/1966 |
| JP | 1051129 | 2/1989 |
| WO | WO 02/34872 A1 | 5/2002 |

OTHER PUBLICATIONS

IRIS Diaphragm Control Valve—BS, website http://www.eggerpumps.com/IRIS ,tabs Characteristics, Constructions and Materials, Flow Measurement—3 pages.

European Search Report, Application No. 10173270.Sep. 2114, dated Dec. 14, 2010, 6 pp.

* cited by examiner

*Primary Examiner* — Charles Boyer

(74) *Attorney, Agent, or Firm* — James F. McBride; Melissa G. Krasovec; David V. Upite

(57) ABSTRACT

A dynamic orifice is useful in making fabric softening composition.

15 Claims, 1 Drawing Sheet

METHOD FOR MAKING A FABRIC SOFTENER UTILIZING A DYNAMIC ORIFICE CHANGER

FIELD OF THE INVENTION

The present invention relates to method of making fabric softener compositions.

BACKGROUND OF THE INVEN TION

Methods of making fabric softener actives have been described. One way of making fabric softeners is to pump a feed comprising a fabric softening active through an orifice under high pressure. The pressure drop between the inlet to the orifice and the outlet from the orifice results in cavitations, shear, and/or turbulence that forms desirable vesicles of fabric softener active in an aqueous fabric softener composition. Vesicle size and distribution, or microstructure, is often important to the final fabric softener product (often impacting, e.g., stability, homogeneity, viscosity, rheology, and/or fabric softening efficacy, etc.). The concentration of fabric softening active is also variable that influences how to arrive at the desired microstructure. There is a need to quickly, accurately, and predictably adjust a manufacturing parameter to arrive at the desired fabric softening active microstructure.

See e.g., U.S. Pat. Nos. 4,621,023; 4,895,452; 5,380,089; US 2008-0061459; and JP 1051129.

SUMMARY OF THE INVENTION

The present invention attempts to address these and other needs. A first aspect of the invention provides for a method of making a fabric softening composition comprising various steps. A step is directed to feeding a composition comprising a fabric softening active through a dynamic orifice comprising a valve, wherein the valve is in a fixed first position. Another step is directed to changing the position of the valve from a first position to a second position. Yet another step is directed to feeding the composition through the dynamic orifice while the position of the iris valve is changed from the first position to the second position. A second aspect of the invention is directed to those compositions made according to the aforementioned processes.

DETAILED DESCRIPTION OF THE INVENTION

Fabric softening compositions often comprise fabric softening actives. These actives are typically in a desired vesicle size and distribution (i.e., microstructure) in the final product. There are potentially many variables during the manufacturing process that may impact microstructure (including chemical (e.g., salt) and physical (pressures, temperatures, etc.) influences). Further complicating matters is that product manufacturers typically provide fabric softener products at different levels of fabric softening active (e.g., a "top tier" brand may have a high level of active and a "mid tier" brand having less active than the top tier brand). The level of fabric softening active in the composition will also influence manufacturing parameters. Applicants have discovered that the use of a dynamic orifice having a valve defining an opening whereby adjusting the valve (and thus the opening) can quickly and predictably accommodate changes in manufacturing operating conditions (such as the concentration of fabric softening active) to provide the desired vesicle size and distribution of the fabric softening active in the final product. Without wishing to be bound by theory, a change in the opening (holding feeding pressure constant) will generally change kinetic energy densities (but obviously not under all conditions). Generally, there is a direct relationship between the imparted kinetic energy density and the vesicle size/distribution. The dynamic nature of the orifice, i.e., the ability to change the valve and thus the opening, in relatively short order, minimizes waste and reduces any potential down time that may otherwise result in a non-dynamic system.

A first aspect of the invention provides a method of making a fabric softening composition comprising the steps of feeding an aqueous composition, wherein the composition comprising a fabric softening active, through a dynamic orifice. The dynamic orifice comprises a valve, wherein the valve can be changed from a fixed first position to a fixed second position all the while feeding the composition through the dynamic orifice.

Figure 1:
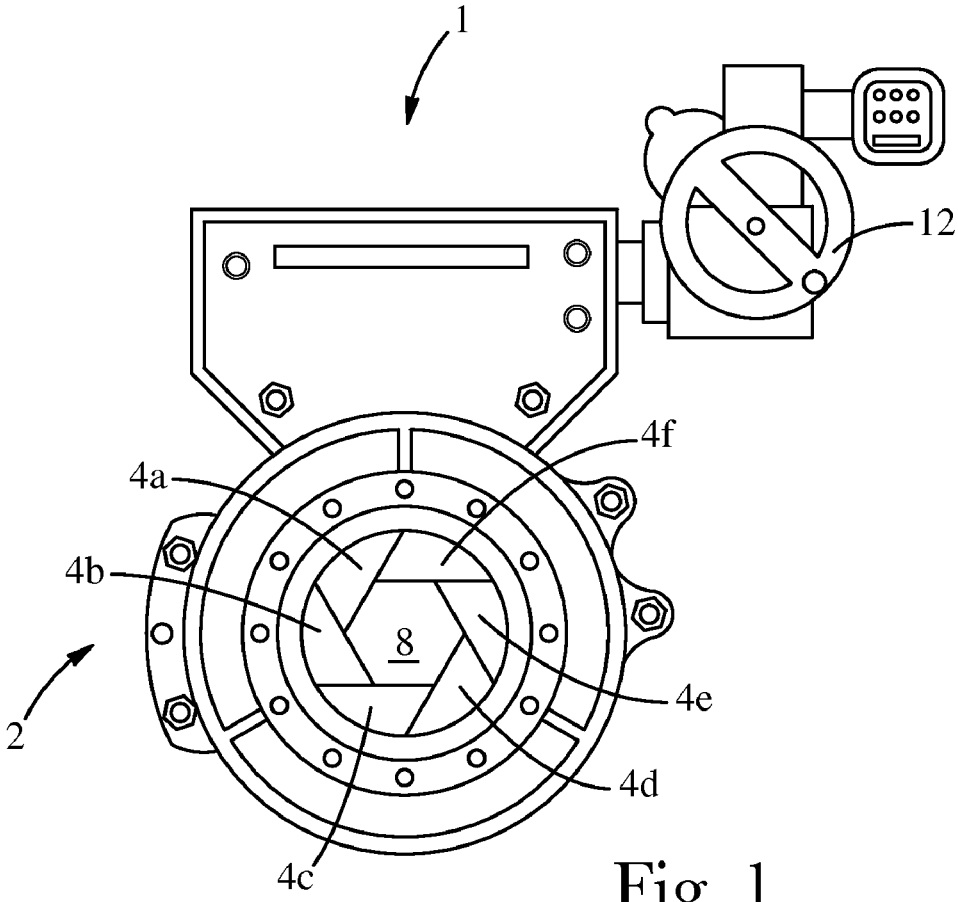
FIG. 1 is a front view of the dynamic orifice having an iris valve defining an opening.
Figure 2:
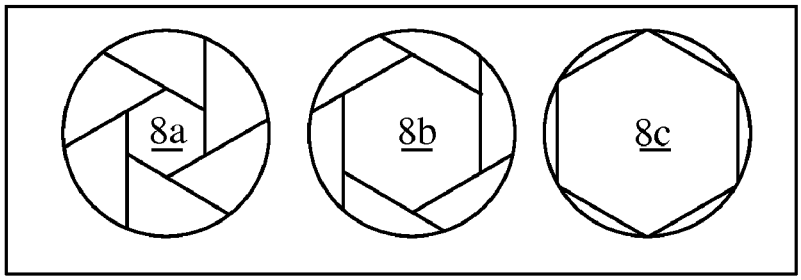
FIG. 2 are various embodiments of the iris valve and the opening sizes.

FIG. 1 is non-limiting example of a dynamic orifice (1) comprising a valve (2). The valve (2) may be an iris type valve having a polygonal cross section, preferably a regular polygonal cross section. "Regular polygonal" means each side of the polygon has the same dimension and each side of the polygon is connected to each other by the same angle. Examples of polygons include those having 3, 4, 5, 6, 7, 8, 9, 10, 11, 12 or more sides. One example of a regular polygonal cross section is that of a hexagon as illustrated in FIG. 1. The valve (2) has an opening (8). The size of the opening (8) is defined by a plurality of curtains (4*a*-4*f*). The number of curtains (4*a*-4*f*) may be directly related to how many sides of the polygon opening (e.g., a hexagon has six sides and thus the iris valve may have six curtains). The curtains (4*a*-4*f*) are preferably each radially adjustable thereby preserving the same polygonal cross section as the hexagonal hole (8) is reduced or enlarged in size. Without wishing to be bound by theory, having a regular polygonal cross section and having each curtain radially adjustable (thereby preserving the regular polygonal cross section shape—irrespective of the size of the hole), provides greater manufacturing predictability since calculating the kinetic energy densities imparted by the change in the opening is trivial (verses, for example, if the cross sectional shape of the hole is changed). Generally the smaller the cross sectional area of the hole (8) the greater the kinetic energy density is imparted to the composition. The curtains (4*a*-4*f*) may be overlapping. Each curtain may be about 10 mm thick.

The curtains (4*a*-4*f*) of the valve (2) may be adjusted manually, for example by way of a manual valve adjuster (12), or by way of automation (not shown). In one embodiment, the valve may adjusted from one position to another position (and yet to a third or more positions) in relatively short order. For example the valve may be adjusted from one position to the next desired position from about 0.001 second (sec) to about 120 sec, alternatively from about 0.5 sec to about 60 sec, alternatively from about 1 sec to about 30 sec, alternatively combinations thereof. Minimize the time that position are adjusted reduces manufacturing product scrap. In one embodiment, the cross sectional area of the hole (8) is from about 2 $mm^2$ to about 2500 $mm^2$, alternatively from about 100 $mm^2$ to about 1500 $mm^2$, alternatively from about 500 $mm^2$ to about 1000 $mm^2$, alternatively combinations thereof.

A composition comprising a fabric softening active is feed through the dynamic orifice. The composition is feed through the orifice by a pipe (or other such conduit) under feed pressure. The diameter of the inlet pipe (to feed the composition through the orifice) is from about 0.5 cm to about 30 cm, alternatively from about 1.2 cm to about 15 cm, alternatively from about 5 cm to about 10 cm. The diameter of the outlet pipe (to receive the composition feed through the orifice) is about 0.5 cm to about 30 cm, alternatively from about 1.2 cm to about 15 cm, alternatively from about 5 cm to about 10 cm. The feed pressure may be from about 34.5 kPa to about 1200 kPa, alternatively from about 50 kPa to about 1,000 kPa, alternatively from about 100 kPa to about 500 kPa, alternatively from about 250 kPa to about 750 kPa, alternatively combinations thereof. The feed pressure may be maintained at the previously identified ranges as the position of the iris valve is changing. The pressure difference between the feed pressure of the composition immediately before going through the dynamic orifice and immediately after going through the orifice is from about 1 psid to about 100 psid, alternatively from about 5 pounds per square inch differential (psid), alternatively from about 25 psid to about 75 psid.

The temperature of the composition immediately for it is feed through the dynamic orifice may be from about 4° C. to about 92° C., alternatively from about 25° C. to about 85° C.

A dynamic orifice may be obtained from Emile Egger & Company Ltd, Pump and Machine Manufacturer, Route de Neuchatel 36, CH-2088 Cressier/NE, Switzerland, IRIS Diaphram Control Valve—BS.

Liquid fabric softening compositions (such as those contained in DOWNY) comprise a fabric softening active. One class of fabric softener actives includes cationic surfactants. Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1% to about 30%, alternatively from about 10% to about 25%, alternatively from about 15 to about 20%, alternatively from about 1% to about 5%, alternatively combinations thereof, of fabric softening active by weight of the final composition. Fabric softening compositions, and components thereof, are generally described in US 2004/0204337. In one embodiment, the fabric softening composition is a so called rinse added composition. In such embodiment, the composition is substantially free of detersive surfactants, alternatively substantially free of anionic surfactants. In another embodiment, the pH of the fabric softening composition is acidic, for example between pH 2 to about 5, alternatively from pH 2.5 to about 4.5, alternatively from pH 3 to about 4, alternatively combinations thereof. In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an aklyating agent.

EXAMPLES

Various concentrations of fabric softening containing compositions are made. The dynamic orifice comprises an iris type valve having a hexagonal cross section. The cross sectional hole is measured from one side of the hexagon to the other opposite side, i.e., width of the hexagonal hole. In a first example, a 40.31 mm hole is used for making composition comprising 10% DEEDMAC (i.e., 10% fabric softening active) white base. The term "white base" means a fabric softening composition that is free of dyes, perfumes, and other ingredients that are typically used to differentiate product variants (e.g., based on color and scent etc.). A flow rate of 1900 lb/min (861.8 kg/min) was used to feed the composition comprising 10% DEEDMAC through the hexagonal hole to provide a white base with acceptable microstructures. In a second example, a 35.35 mm hole is used for making an acceptable composition (i.e., having acceptable microstructures) comprising 12.2% DEEDMAC white base with a flow rate at 1770 lb/min and 2000 lb/min. In a third example, a 31 mm hole is used for making an acceptable composition for a 17.3% DEEDMAC white base with a feed pressure at 30 psid. In a final example, a 25.1 mm hole is used for the 21.1% DEEDMAC white base with a flow rate at 1770 and 2000 lb/min. In one embodiment, the flow rate to the hole is from about 1,000 lb/min to about 3,000 lb/min.

All percentages and ratios used herein are by weight of the total composition and all measurements made are at 25° C., unless otherwise designated.

All measurements used herein are in metric units unless otherwise specified.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited are, in relevant part, incorporated herein by reference; the citation of any document is not to be construed as an admission that it is prior art with respect to the present invention.

What is claimed is:

1. A method of making a fabric softening composition comprising the steps:

a) feeding an aqueous composition comprising a fabric softening active through a dynamic orifice comprising a valve,
wherein the valve is in a fixed first position;

c) changing the position of the valve from a first position to a second position;

d) feeding the composition through the dynamic orifice while the position of the iris valve is changed from the first position to the second position.

2. The method of claim 1, wherein the valve is an iris valve having a polygonal cross section.

3. The method of claim 2, wherein the iris valve has a regular polygonal cross section.

4. The method of claim 3, wherein the polygonal cross section is chosen from a 4-, 5-, 6-, 7-, 8-, 9-, 10-, 11-, or 12-sided polygon.

5. The method of claim 4, wherein the polygon is 5-, 6-, or 7-sided polygon.

6. The method of claim 3, wherein the opening of the first position and the second position of the iris valve has a cross sectional area from about 2 $mm^2$ to about 2500 $mm^2$.

7. The method of claim 6, wherein the iris valve comprises a plurality of curtains that each all radially adjust to provide the first position or the second position.

8. The method of claim 7, wherein the step of feeding the composition through the dynamic orifice comprises feeding under a first feeding pressure, wherein the first feeding pressure is from about 34.5 kPa to about 1200 kPa.

9. The method of claim 8, wherein the step of feeding the composition through the dynamic orifice while the valve is changed from the first position to the second position comprises feeding under second feed pressure, wherein the second feeding pressure is from about 34.5 kPa to about 1200 kPa.

10. The method of claim 9, wherein the step of changing the valve from the first position to the second position is conducted in about 0.001 second to about 60 seconds.

11. The method of claim 10, wherein the step of changing the valve from the first position to the second position is conducted in about 0.1 second to about 60 seconds.

12. The method of claim 10, further comprising the step of feeding the composition through the dynamic orifice while the iris valve is in the second position having a third feed pressure from about 34.5 kPa to about 1200 kPa.

13. The method of claim 12, further comprising the steps:

a) changing the position of the valve from the second position to a third position;

b) feeding the composition through the dynamic orifice while the position of the iris valve is changed from the second position to the third position.

14. The method of claim 1, wherein the fabric softening active is a quaternary ammonium compound suitable for softening fabric.

15. A composition made according to the method of claim 1.

* * * * *